United States Patent [19]

Klein et al.

[11] 4,209,761

[45] Jun. 24, 1980

[54] CIRCUIT BREAKER AUXILIARY SWITCH APPARATUS

[75] Inventors: Keith W. Klein, Simsbury; Joseph M. Palmieri, Southington, both of Conn.

[73] Assignee: General Electric Company, New York, N.Y.

[21] Appl. No.: 940,417

[22] Filed: Sep. 7, 1978

[51] Int. Cl.[2] ..... H01H 73/12; H01H 75/00; H01H 73/00

[52] U.S. Cl. ..... 335/17; 200/308

[58] Field of Search ..... 335/13, 17, 18, 20, 335/34, 168, 169, 170; 200/308

[56] References Cited

U.S. PATENT DOCUMENTS

| | | | |
|---|---|---|---|
| 3,256,407 | 6/1966 | Klein | 335/37 X |
| 3,288,965 | 11/1966 | Klein | 335/37 X |
| 3,464,040 | 8/1969 | Powell | 335/191 |
| 3,973,230 | 8/1976 | Ciarcia et al. | 335/17 X |
| 4,112,270 | 9/1978 | Rys | 335/17 X |

*Primary Examiner*—Fred L. Braun

*Attorney, Agent, or Firm*—Robert A. Cahill; Walter C. Bernkopf; Philip L. Schlamp

[57] ABSTRACT

Actuating elements, operatively coupled with an external circuit breaker manual operating handle and with a circuit breaker internal trip actuating member, are selectively operated to activate an auxiliary switch when the circuit breaker is opened either manually via its operating handle or automatically in response to an abnormal external circuit condition.

5 Claims, 2 Drawing Figures

FIG. 1
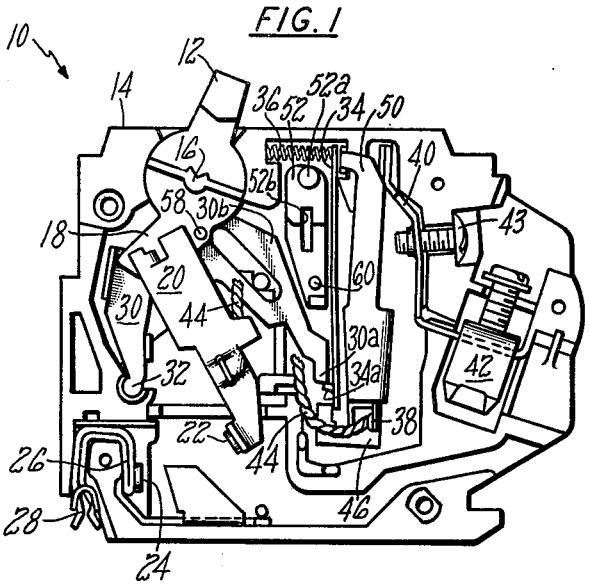
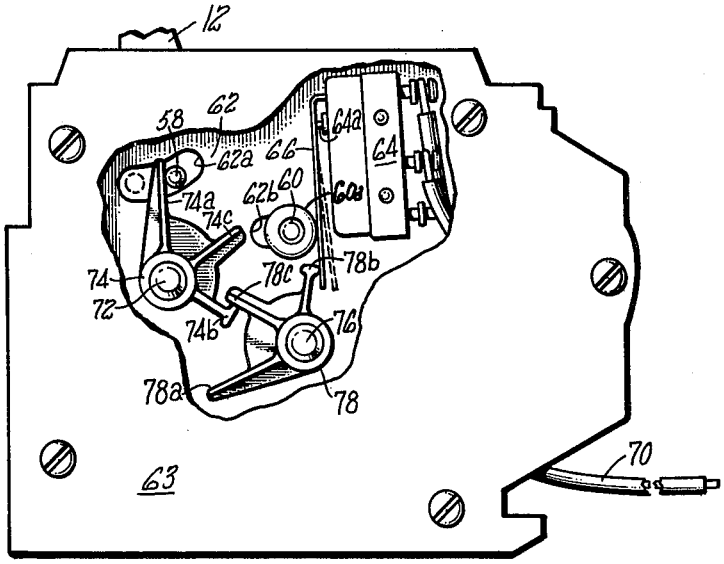
FIG. 2

CIRCUIT BREAKER AUXILIARY SWITCH APPARATUS

BACKGROUND OF THE INVENTION

The present invention relates to accessory apparatus for circuit breakers and particularly to auxiliary switch apparatus for residential, molded case circuit breakers.

Commonly assigned U.S. Pat. Nos. 3,256,407 and 3,973,230, disclose residential molded case circuit breakers to which have been adapted auxiliary switch apparatus of the so-called "bell alarm" type. In accordance with this type of auxiliary switch, a change in switch condition is effected only when the circuit breaker is automatically tripped open, but not when the circuit breaker is opened manually via its external operating handle. Thus a bell alarm switch is utilized to control an external alarm circuit operating to alert personnel when a circuit breaker has tripped automatically in response to an abnormal circuit condition, e.g., overcurrent, ground fault and undervoltage, on the protected circuit; conditions requiring corrective measures. Since manual opening of a circuit breaker is normally not intended to call for corrective measures, no such alarm or signal is desired.

In certain applications however, it is desired to alert personnel when a circuit breaker is opened, regardless of whether it is tripped open or manually opened. The straightforward approach to achieving this function is to mechanically translate the opening movement of the breaker contacts into actuation of an auxiliary switch. In the case of residential molded case circuit breakers however, this straightforward approach is difficult to implement structurally.

It is accordingly an object of the present invention to provide improved auxiliary switch apparatus operating to produce an auxiliary switch actuation incident with the opening of a circuit breaker, regardless of how effected.

An additional object is to provide auxiliary switch apparatus of the above character which is compact, simple in construction, and reliable in operation.

Yet another object is to provide auxiliary switch apparatus of the above character which can be readily adapted to small residential, molded case circuit breakers with minimal modification to the breaker itself.

Other objects of the invention will in part be obvious and in part appear hereinafter.

SUMMARY OF THE INVENTION

In accordance with the present invention, there is provided auxiliary switch apparatus of compact construction capable of being accommodated in a molded accessory case affixed in side-by-side relation with one or more residential molded case circuit breakers. This accessory case can, for example, be constituted by an empty molded circuit breaker case of the same configuration as that of the circuit breaker to which it is affixed. Alternatively, the accessory case may be constituted by one compartment of a molded case with the circuit breaker accommodated in a second compartment thereof; the two compartments being separated by a common wall. In either situation, the pivotal circuit breaker operating handle mounts a pin which extends laterally into the accessory case through a clearance opening in the wall or walls separating the two cases. A second pin, carried by an internal trip actuating member of the circuit breaker, also extends laterally into the accessory case. An auxiliary switch, mounted within the accessory case, has a resilient actuating arm disposed in proximate relation to the second pin. When the circuit breaker is tripped, either directly by operation of its own trip unit or indirectly by operation of the trip unit of another circuit breaker operatively coupled thereto by an internal common trip bar ganging their trip actuating members together, the second pin is articulated into deflecting engagement with the switch actuating arm. The auxiliary switch is thus actuated incident with tripping of the circuit breaker.

To achieve switch actuation incident with manual opening of the circuit breaker, the handle mounted first pin engages a finger of a rotatably mounted, handle actuated element incident with pivotal movement of the handle to its OFF position. The resulting rotational movement of this element swings a second finger thereof into engagement with a finger of a separate, rotatably mounted switch actuating element, thereby causing a second finger thereof to swing into actuating engagement with the switch actuating arm. Thus, auxiliary switch actuation is achieved incident with manual switching of a circuit breaker to its OFF condition, as desired.

The invention accordingly comprises the features of construction, combination of elements, and arrangement of parts which will be exemplified in the description hereinafter set forth, and the scope of the invention will be indicated in the claims.

For a better understanding of the nature and objects of the invention, reference should be had to the following detailed description taken in conjunction with the accompanying drawing, in which:

FIG. 1 is a side elevational view of the internal parts of a typical residential molded case circuit breaker to which the auxiliary switch apparatus of the present invention is adaptable; and FIG. 2 is a side elevational view, partially broken away, of auxiliary switch apparatus constructed in accordance with the present invention.

Corresponding reference numerals refer to like parts throughout the several views of the drawing.

DETAILED DESCRIPTION

FIG. 1 of the drawing illustrates a typical residential, molded case circuit breaker to which the auxiliary switch apparatus of the present invention is adaptable. This circuit breaker, generally indicated at 10, may be of the construction disclosed in commonly assigned U.S. Pat. No. 3,464,040. In order to promote a complete understanding of the auxiliary switch apparatus of the present invention, it is believed desirable to briefly review the circuit breaker construction of this patent. Thus as seen in FIG. 1 herein, a circuit breaker 10 includes a manual operating handle 12 which is pivotally mounted in a molded circuit breaker case 14 by means of oppositely extending, integrally formed hub portions 16. The handle includes a depending portion 18 to which the upper end of a movable contact arm 20 is pivotally connected. A movable contact 22 is affixed to the lower end of arm 20 for engagement with a stationary contact 24 carried by a depending line strap 26 integrally formed with terminal jaws 28 adapted for plug-on electrical contacting engagement with a line stab in a circuit breaker load center (not shown). A tension spring (not shown) is connected between movable contact arm 20 and a cradle 30 which is pivotally mounted at one end in the case 14, as indicated at 32.

The cradle is normally retained in its position shown by a latch 34*a* in the form of a tab struck from a depending armature 34 pivotally mounted at its upper end in the circuit breaker case. A spring 36 biases the depending portion of the armature to the left, thus ensuring that the latch is in position to engage a tip 30*a* of cradle 30, pursuant to retaining the breaker operating mechanism in its untripped condition.

Included in the circuit breaker internal circuit is an elongated bimetal 38 which is mounted at its upper end to the inner end of a load strap 40 extending outwardly from the case interior to a wire lug 42 facilitating external connection with a load circuit (not shown). The load strap is affixed to the breaker case by a screw 43. Completing the circuit breaker internal circuit, a braid 44 is electrically connected between movable contact arm 20 and the lower end of bimetal 38.

To effect a thermal trip function in response to overload currents, the lower end portion of bimetal 38 deflects to the right as seen in FIG. 1, and this movement is communicated to armature 34 via an armature hook 46. Corresponding rightward movement of the armature disengages latch 34*a* from the cradle tip 30*a* to unlatch the breaker operating mechanism and thus open the breaker contacts 22 and 24.

To accommodate rapid tripping of the circuit breaker in response to heavy overload or short circuit currents, as elongated magnetic field piece 50 is mounted at its upper end to the breaker case and has a lower end portion of U-shaped cross-section disposed in partially embracing relation with bimetal 38. With the flow of current of heavy overload and short circuit proportions through the bimetal sufficient flux is developed in this field piece to attract armature 34 rightward and thus pull latch 34*a* away from latching engagement with cradle tip 30*a*, tripping the circuit breaker.

In order that the circuit breaker may be tripped externally, for example in response to the tripping of a companion circuit breaker ganged thereto in a two or three-pole configuration or in response to a ground fault condition, a trip actuating member 52 is pivotally mounted at its upper end in the breaker case by means of integrally formed trunions 52*a* for pendency in proximate relation with armature 34. As more clearly seen in the above-noted U.S. Pat. No. 3,464,040, when cradle 30 is released by armature 34, the breaker mechanism spring acts to pivot the cradle in the clockwise direction seen in FIG. 1 herein, thereby swinging a knee portion 30*b* thereof into engagement with a trip actuating member 52. The trip actuating member is thus pivoted in the counterclockwise direction, swinging its lower end rightward toward armature 34. To provide internal common tripping for plural circuit breakers ganged together in two and three-pole configurations, the trip actuating members 52 of the ganged circuit breakers are tied together by a common trip bar (not shown) which is received in rectangular apertures 52*b* thereof, seen in FIG. 1. A detailed disclosure of a typical internal common tripping provision for single pole breakers ganged together in two and three-pole configurations may be found in U.S. Pat. No. 3,288,965. Thus, when one of these ganged circuit breakers trips in response to overload or short circuit currents flowing through its circuit pole, the released cradle therein impacts against its associated trip actuating member 52, causing all of the trip actuating members of the other circuit breakers to be pivoted into unlatching engagement with their associated armatures 34. Thus, when one circuit breaker trips, all of the other circuit breakers are coincidentally tripped.

Trip actuating member 52 is also utilized when circuit breaker 10 is utilized in a ground fault circuit interrupting (GFCI) configuration. To this end, the trip actuating member 52 is operatively coupled with a trip solenoid acting to swing it into tripping engagement with armature 34 upon being energized by a ground fault module in responding to a ground fault condition on the circuit breaker load circuit.

To adapt circuit breaker 10 for utilizing the auxiliary switch apparatus of the present invention seen in FIG. 2, a first elongated, laterally extending pin 58 is mounted by the depending portion 18 of handle 12, and a second elongated, laterally extending pin 60 is mounted by trip actuating member 52 adjacent its lower end. Turning to FIG. 2, it is seen that pin 58 extends through an arcuate opening 62*a* provided in the wall or walls 62 separating the circuit breaker case from an auxiliary case 63 affixed thereto. Similarly, pin 60 extends into the accessory case through an opening 62*b* in the case separating wall. Mounted in the accessory case is an auxiliary switch 64 having an actuating pin 64*a*. This switch in turn mounts one end of an elongated, flexible actuating arm 66 disposed in actuating relation with actuating pin 64*a*. To take up the displacement between the normal position of pin 60 and the unactuated disposition of actuating arm 66 and to promote electrical isolation between the breaker parts and the switch actuating arm, an insulative spacer sleeve 60*a* is fitted on pin 60. It is seen that when circuit breaker 10 is tripped, either by operation of its own trip unit, the trip unit of a companion circuit breaker, or the firing of a ground fault trip solenoid, trip actuating member 52 is swung in the counterclockwise direction, causing its pin 60 to swing rightward as seen in FIGS. 1 and 2. Switch actuating arm 66 is thus deflected to its phantom line position as seen in FIG. 2, depressing actuating pin 64*a* to achieve actuation of auxiliary switch 64. This switch actuation is manifested in an external alarm circuit into which the auxiliary switch is wired via leads 70 emanating from the accessory case 64.

In order to translate the operation of circuit breaker handle 12 from its ON position seen in FIG. 2 to its OFF position seen in FIG. 1 into actuation of auxiliary switch 64, wall 62 mounts a post 72 on which is rotatably mounted a handle actuated element 74. This element carries a first finger 74*a* which extends upwardly into engaging relation with pin 58 carried by operating handle 12. Thus, when the handle is pivoted in the clockwise direction to its OFF position, pin 58 is swung to the left, engaging finger 74*a* to induce counterclockwise rotation of element 74. Wall 62 additionally mounts a second pivot post 76 on which is rotatably mounted a switch actuating element 78. This element carries a finger 78*c* which extends radially outward into engaging relation with a finger 74*b* carried by switch actuated element 78. It is thus seen that when handle actuated element 74 is rotated in the counterclockwise direction in response to the pivoting of the operating handle 12 to its OFF position, finger 74*b* thereof picks up finger 78*c* of switch actuating element 78 to induce clockwise rotation thereof. As a consequence, a second finger 78*b* of the switch actuating element is swung into engagement with actuating arm 66, deflecting it to its phantom line position to effect actuation of auxiliary switch 64. When operating handle is pivoted back to its ON position, the resiliency of switch actuating arm 66 returns the elements 74 and 78 to their angular positions shown, as determined by the position of pin 58.

An additional point to be noted is that when the breaker is tripped, causing pin 60 to effect auxiliary switch actuation, handle 12 moves to an intermediate trip indicating position. To reset the breaker mechanism, i.e., elevate cradle tip 30*a* back into latching engagement with armature latch 34*a*, handle 12 is pivoted to its OFF position. In the resetting process, cradle knee 30*b* releases trip actuating member 52 and thus pin 60 swings away from switch actuating arm 66. However auxiliary switch deactuation is not permitted, since, with handle 12 assuming its OFF position, pin 58, via elements 74 and 78, will have swung finger 78*b* into switch actuation sustaining engagement with arm 66.

It is noted that handle actuated element 74 and switch actuating element 78 are indentically constructed and fully interchangeable for manufacturing and assembly economies. When the element is mounted on post 72, its finger 74*c* serves no function. On the other hand, when the element is mounted in post 76, finger 78*a* has no useful purpose. As illustrated, auxiliary switch 64 may comprise two switch units actuated in single throw, double pole fashion with the individual switches either of the normally open or normally closed types.

It will thus be seen that the object set forth above, among those made apparent in the preceding description, are efficiently attained and, since certain changes may be made in the above construction without departing from the scope of the invention, it is intended that all matter contained in the above description or shown in the accompanying drawings shall be interpreted as illustrative and not in a limiting sense.

Having described our invention, what we claim as new and desire to secure by Letters Patent is:

1. Auxiliary switch apparatus for a molded case circuit breaker having an internal trip unit including a pivotal trip actuating member and an operating mechanism including a pivotal manual operating handle, said apparatus comprising, in combination:

A. an accessory case affixed in side-by-side relation with the circuit breaker;

B. an auxiliary switch mounted within said accessory case, said switch including a switch actuating arm;

C. a first pin mounted by the breaker operating handle for extension into said accessory case;

D. a second pin mounted by the breaker trip actuating member for extension into said accessory case in proximate relation with said switch actuating arm, whereby tripping of the breaker is accompanied by pivotal movement of the trip actuating member in a direction to swing said second pin into switch actuating engagement with said arm; and E. translating means movably mounted within said accessory case and activated into switch actuating engagement with said arm by the movement of said first pin as the breaker handle is pivoted to its OFF position.

2. The auxiliary switch apparatus defined in claim 1, wherein said translating means includes (1) a first rotatable member having a first finger disposed in engaging relation with said first pin and a second finger, and (2) a second rotatable member having a first finger disposed in engaging relation with said second finger of said first member and a second finger disposed in engaging relation with said switch actuating arm, (3) whereby said first member is rotated by said first pin as the handle is pivoted to its OFF position and said second member is rotated by said first member to swing said second finger of said second member into switch actuating engagement with said arm.

3. The auxiliary switch apparatus defined in claim 2, wherein said first and second members are identically constructed and fully interchangeable.

4. The auxiliary switch apparatus defined in claim 2, wherein said switch actuating arm is resilient and thus capable of returning said first and second members to their normally angular positions as said first pin is repositioned incident with the pivoting of the breaker operating handle to its ON position.

5. The auxiliary switch apparatus defined in claim 4, wherein said first and second members are identically constructed and fully interchangeable.

* * * * *